US007448910B2

(12) United States Patent
Chun et al.

(10) Patent No.: US 7,448,910 B2
(45) Date of Patent: Nov. 11, 2008

(54) DISPLAYING APPARATUS

(75) Inventors: Hyun-jin Chun, Hwascong-si (KR); Young-ho Kim, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 679 days.

(21) Appl. No.: 11/216,126

(22) Filed: Sep. 1, 2005

(65) Prior Publication Data

US 2006/0051998 A1 Mar. 9, 2006

(30) Foreign Application Priority Data

Sep. 3, 2004 (KR) ..... 10-2004-0070439

(51) Int. Cl.
*H01R 33/76* (2006.01)

(52) U.S. Cl. ..... 439/618; 439/620.05

(58) Field of Classification Search ..... 439/618, 439/182, 683, 620.05; 313/318.01, 318.05, 313/318.06

See application file for complete search history.

(56) References Cited

U.S. PATENT DOCUMENTS

| | | | | |
|---|---|---|---|---|
| 3,345,134 | A | 10/1967 | Heymer et al. | |
| 4,156,161 | A * | 5/1979 | Pittman | 313/325 |
| 4,253,717 | A * | 3/1981 | Stewart | 439/101 |
| 4,266,158 | A * | 5/1981 | Uda et al. | 313/325 |
| 4,378,511 | A * | 3/1983 | Simovits, Jr. | 313/325 |
| 4,400,645 | A * | 8/1983 | Simovits, Jr. et al. | 313/325 |
| 4,534,100 | A | 8/1985 | Lane | |
| 4,906,314 | A | 3/1990 | Farnworth et al. | |
| 5,130,783 | A | 7/1992 | McLellan | |
| 5,371,397 | A | 12/1994 | Maegawa et al. | |
| 5,424,573 | A | 6/1995 | Kato et al. | |
| 5,435,887 | A | 7/1995 | Rothschild et al. | |
| 5,505,804 | A | 4/1996 | Mizuguchi et al. | |
| 5,593,913 | A | 1/1997 | Aoki | |
| 5,605,783 | A | 2/1997 | Revelli et al. | |
| 5,672,519 | A | 9/1997 | Song et al. | |
| 5,694,246 | A | 12/1997 | Aoyama et al. | |
| 5,708,293 | A | 1/1998 | Ochi et al. | |
| 5,745,348 | A * | 4/1998 | Cha | 361/815 |
| 5,771,158 | A | 6/1998 | Yamagishi et al. | |
| 5,776,824 | A | 7/1998 | Farnworth et al. | |
| 5,811,799 | A | 9/1998 | Wu | |
| 5,821,532 | A | 10/1998 | Beaman et al. | |

(Continued)

FOREIGN PATENT DOCUMENTS

| | | |
|---|---|---|
| JP | 07-66581 | 3/1995 |

(Continued)

*Primary Examiner*—Ross N Gushi
(74) *Attorney, Agent, or Firm*—Stanzione & Kim, LLP

(57) ABSTRACT

A displaying apparatus includes a cathode ray tube (CRT), a printed circuit board (PCB) provided at a rear end of the CRT, a CRT socket to electrically connect the CRT and the PCB, a cable coupling part formed adjacent to the CRT socket, a high voltage cable coupled to the cable coupling part, and an electromagnetic wave shielding member provided inside the cable coupling part in contact with the high voltage cable to shield the displaying apparatus from electromagnetic waves generated by the high voltage cable. Thus the displaying apparatus is capable of shielding from electromagnetic waves generated in the process of applying high voltage to the CRT in a simple and effective manner.

22 Claims, 4 Drawing Sheets

U.S. PATENT DOCUMENTS 5,841,234 A * 11/1998 Jeong ..... 315/85
5,857,963 A 1/1999 Pelchy et al.
5,861,654 A 1/1999 Johnson
5,877,040 A 3/1999 Park et al.
5,897,338 A 4/1999 Kaldenberg
5,914,488 A 6/1999 Sone
5,977,535 A 11/1999 Rostoker
5,998,862 A 12/1999 Yamanaka
6,019,642 A * 2/2000 Nagata ..... 439/683
6,080,291 A 6/2000 Woodruff et al.
6,094,002 A * 7/2000 Bae et al. ..... 313/318.01
6,104,086 A 8/2000 Ichikawa et al.
6,114,240 A 9/2000 Akram et al.
6,143,588 A 11/2000 Glenn
6,236,046 B1 5/2001 Watabe et al.
6,259,083 B1 7/2001 Kimura
6,266,197 B1 7/2001 Glenn et al.
6,345,997 B1 * 2/2002 Shon ..... 439/181
6,354,880 B2 * 3/2002 Arai ..... 439/620.23
6,528,932 B2 * 3/2003 Arakawa et al. ..... 313/318.01
6,570,331 B2 * 5/2003 Arakawa et al. ..... 315/3
6,582,254 B2 * 6/2003 Arakawa et al. ..... 439/683
6,633,140 B2 * 10/2003 Lee ..... 315/363
6,746,259 B2 * 6/2004 Arai ..... 439/182
6,894,732 B2 * 5/2005 Kim et al. ..... 348/836
7,209,345 B2 * 4/2007 Jang ..... 361/682
2002/0160664 A1 * 10/2002 Arakawa et al. ..... 439/682
2003/0022546 A1 * 1/2003 Solomich et al. ..... 439/362
2003/0062601 A1 4/2003 Hamden et al.
2004/0012698 A1 1/2004 Suda et al.
2004/0023469 A1 2/2004 Suda
2004/0038442 A1 2/2004 Kinsman
2004/0041261 A1 3/2004 Kinsman
2004/0082094 A1 4/2004 Yamamoto
2004/0214373 A1 10/2004 Jiang et al.
2004/0245649 A1 12/2004 Imaoka
2005/0052751 A1 3/2005 Liu et al.
2005/0104228 A1 5/2005 Rigg et al.
2005/0110889 A1 5/2005 Tuttle et al.
2005/0127478 A1 6/2005 Hiatt et al.
2005/0151228 A1 7/2005 Tanida et al.
2005/0236708 A1 10/2005 Farnworth et al.
2005/0254133 A1 11/2005 Akram et al.

FOREIGN PATENT DOCUMENTS

JP 07-202478 8/1995
KR 1999-30307 7/1999
KR 2002-50804 6/2002

* cited by examiner

DISPLAYING APPARATUS

CROSS-REFERENCE TO RELATED APPLICATIONS

This application claims the benefit of Korean Patent Application No. 2004-70439 filed on Sep. 3, 2004, in the Korean Intellectual Property Office, the disclosure of which is incorporated herein in its entirety by reference.

BACKGROUND OF THE INVENTION

1. Field of the Invention

The present general inventive concept relates to a displaying apparatus, and more particularly, to a displaying apparatus capable of electrically interconnecting a cathode ray tube (CRT) and a printed circuit board (PCB) through a CRT socket.

2. Description of the Related Art

The term "displaying apparatus" used in this description collectively refers to various kinds of apparatuses that visually display data including text or pictures on a display panel.

A CRT-type displaying apparatus comprises a cathode ray tube (CRT) having a plurality of CRT lead pins disposed in a circular arrangement, a printed circuit board (PCB) provided at a rear end of the CRT, and a CRT socket electrically interconnecting the CRT and the PCB. The CRT socket includes a plurality of pin holes through which the CRT lead pins are coupled and a plurality of socket pins mounted on the PCB. The CRT socket is formed with a pipe-shaped cable coupling part, to which a high voltage cable is coupled, whereby a high voltage generated by a fly back transformer (FBT) can be applied to the CRT.

In the CRT displaying apparatus, unwanted electromagnetic waves may be generated in the process of applying the high voltage generated by the FBT to the CRT. If these electromagnetic waves are not properly shielded, they may cause peripheral devices to malfunction. Conventional CRT displaying apparatuses use either a shield line wound around the high voltage cable or an electromagnetic shielding member installed on the FBT to shield from the electromagnetic waves generated in the process of applying the high voltage to the CRT.

However, the conventional CRT displaying apparatuses employing the shielding devices described above tend to have structures that are relatively complicated, and using these structures to shield from the electromagnetic waves generated in the process of applying the high voltage to the CRT is expensive.

SUMMARY OF THE INVENTION

The general inventive concept provides a displaying apparatus capable of shielding the displaying apparatus from electromagnetic waves generated in the process of applying a high voltage to a CRT in a simple and effective manner.

Additional aspects and/or advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a displaying apparatus comprising a cathode ray tube (CRT), a printed circuit board (PCB) provided at a rear end of the CRT, a CRT socket to electrically connect the CRT and the PCB, a cable coupling part formed adjacent to the CRT socket, a high voltage cable coupled to the cable coupling part, and an electromagnetic wave shielding member provided inside the cable coupling part and in contact with the high voltage cable to shield the displaying apparatus from electromagnetic waves generated by the high voltage cable.

The electromagnetic wave shielding member may have a cylindrical structure formed with a penetrating hole through which an end of the high voltage cable passes to a contact.

The electromagnetic wave shielding member may comprise a ferrite material.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
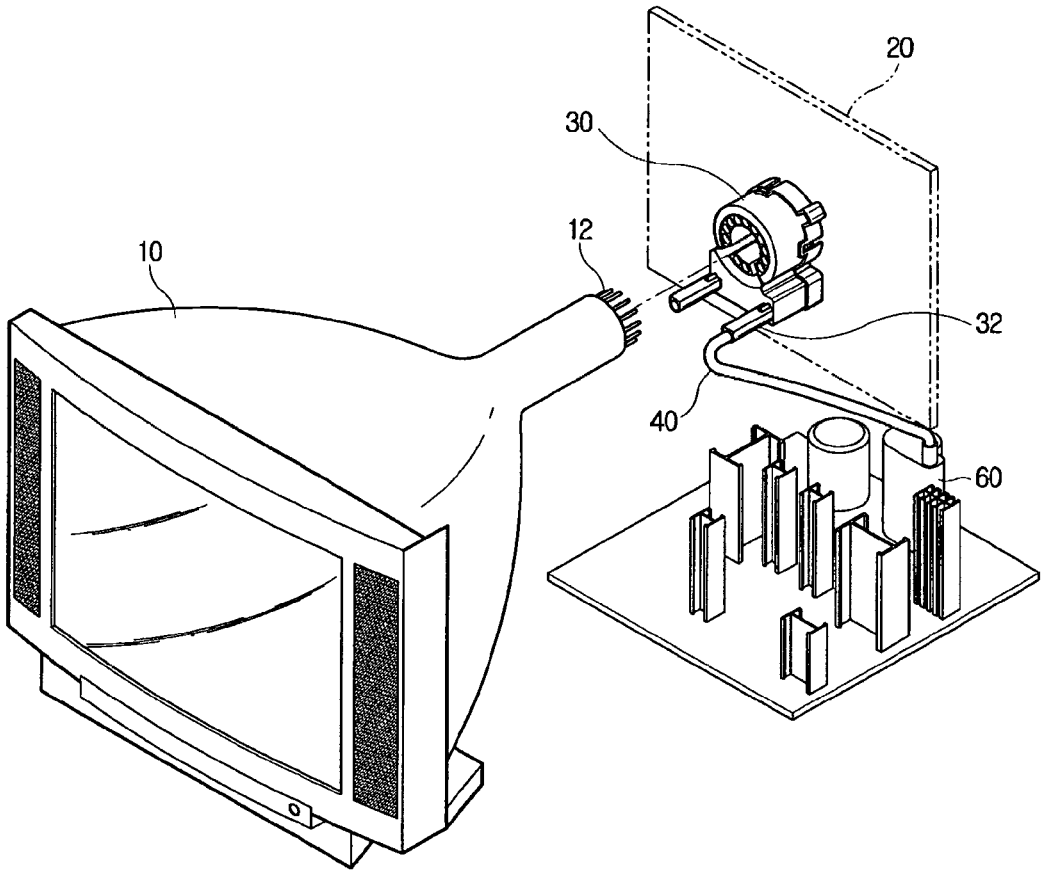
FIG. 1 is a perspective view illustrating a displaying apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
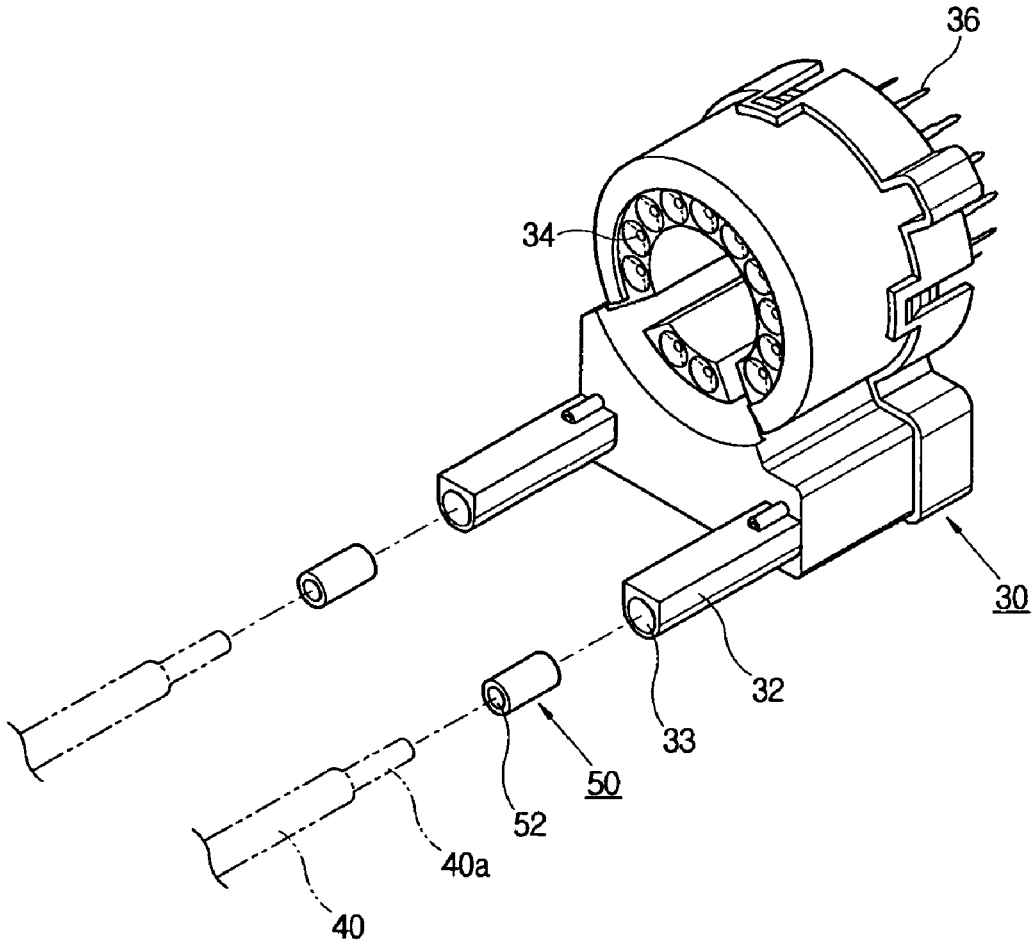
FIG. 2 is a perspective view illustrating a CRT socket and an electromagnetic wave shielding member of the displaying apparatus of FIG. 1.
Figure 3:
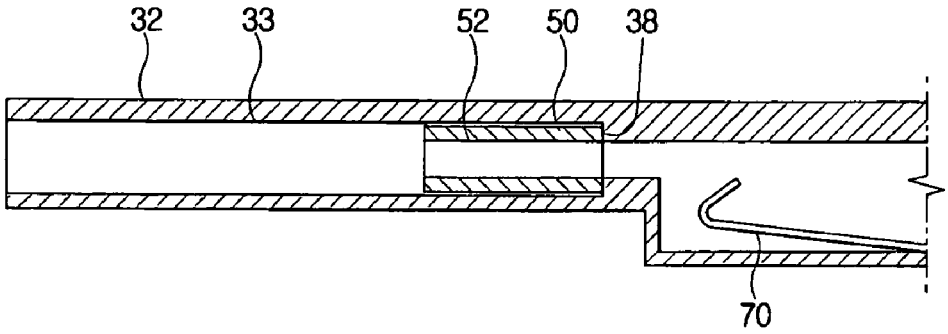
FIG. 3 is a sectional view illustrating a coupling structure of the CRT socket and the electromagnetic wave shielding member of the displaying apparatus of FIG. 1.

Referring to FIGS. 1 through 3, a displaying apparatus according to an embodiment of the present general inventive concept comprises a cathode ray tube (CRT) 10, a printed circuit board (PCB) 20 provided at a rear end of the CRT 10, a CRT socket 30 to electrically connect the CRT 10 and the PCB 20 and having a cable coupling part 32 formed on one side thereof, a high voltage cable 40 coupled to the cable coupling part 32 of the CRT socket 30, and an electromagnetic wave shielding member 50 (see FIGS. 2 and 3) provided inside the cable coupling part 32 of the CRT socket 30 to shield the displaying apparatus and surrounding devices from electromagnetic waves generated in the high voltage cable 40 by contacting the high voltage cable 40.

The rear end of the CRT includes a neck part having a plurality of CRT lead pins 12 disposed in a circular arrangement.

The PCB 20 includes a predetermined pattern of circuits. A variety of circuit components including an integrated chip (IC) are disposed on the PCB 20.

The CRT socket 30 is provided between the CRT 10 and the PCB 20. A plurality of pin holes 34 are formed on one side of the CRT socket 30 adjacent to the CRT 10 and opposite to the PCB 20 to be coupled to the plurality of CRT lead pins 12 disposed in the circular arrangement on the rear end of the CRT 10. The plurality of pin holes 34 on the CRT socket 30 correspond to the plurality of CRT lead pins 12, and are also arranged in a circular arrangement. A plurality of socket pins 36 are formed on the other side of the CRT socket 30 adjacent to the PCB 20 and opposite the CRT 10 to be coupled to the PCB 20, and may also be arranged in a circular arrangement. With this configuration, the CRT 10 receives a variety of signals generated from the PCB 20 applied through the CRT socket 30, thereby forming images thereon.

An elongated cable inserting hole 33 is formed on the cable coupling part 32 and is provided integrally with the CRT socket 30. The high voltage cable 40 is inserted into the cable inserting hole 33 of the cable coupling part 32 to be electrically connected to the plurality of CRT lead pins 12, thereby applying the high voltage carried on the high voltage cable 40 to the CRT 10.

The cable coupling part 32 functions to receive the high voltage carried on the high voltage cable 40, and the high voltage applied to the cable coupling part 32 is applied to the CRT 10 through the plurality of CRT lead pins 12 that are coupled to the plurality of pin holes 34.

Figure 4:
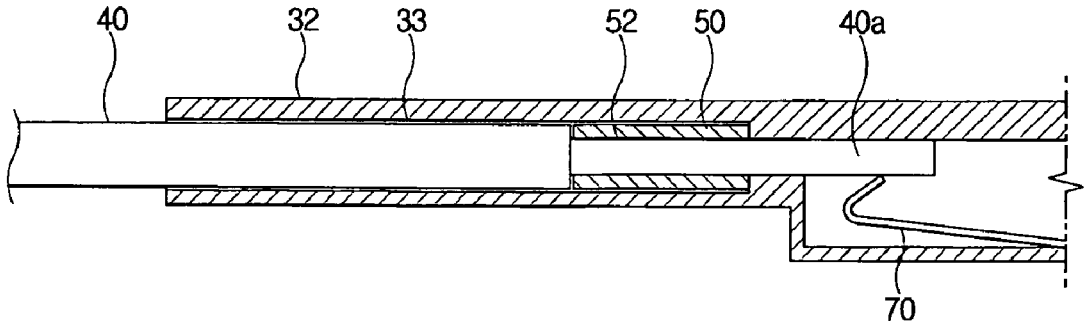
FIG. 4 is a sectional view illustrating a connection state of a high voltage cable to the CRT socket of the displaying apparatus of FIG. 1.

The high voltage cable 40 functions as an intermediary to transmit the high voltage generated in a fly back transformer (FBT) 60 to the CRT socket 30. As illustrated in FIG. 4, a covering of an end 40*a* of the high voltage cable 40 is taken off, and the end 40*a* of the high voltage cable 40 without the covering thereon directly contacts the electromagnetic wave shielding member 50.

A support part 38 capable of supporting the electromagnetic wave shielding member 50 is provided inside the cable coupling part 32.

The electromagnetic wave shielding member 50 may have a cylindrical shape formed with a penetrating hole 52 through which the end 40*a* of the high voltage cable 40 passes to a contact (described below). The electromagnetic wave shielding member 50 may have other various shapes including, for example, a polygonal box shape. Additionally, the end 40*a* of the high voltage cable 40 that passes through the penetrating hole 52 of the electromagnetic wave shielding member 50 is firmly supported by a contact 70 provided inside the CRT socket 30 to be electrically connected to the plurality of CRT lead pins 12.

The electromagnetic wave shielding member 50 comprises a ferrite material that effectively shields electromagnetic waves and is low in cost With reference to FIG. 4, a connection state of the high voltage cable 40 to the cable coupling part 32 of the CRT socket 30 will be described.

The end 40*a* of the high voltage cable 40 coupled to a cable inserting hole 33 of the cable coupling part 32 maintains a contact state with the penetrating hole 52 of the electromagnetic wave shielding member 50 provided inside the cable coupling part 32.

The end 40*a* of the high voltage cable 40 is held in contact with the penetrating hole 52 of the electromagnetic wave shielding member 50 by the contact 70, thereby preventing the end 40*a* of the high voltage cable 40 from being removed from the cable coupling part 32. Accordingly, the electrical connection state of the high voltage cable 40 with the electromagnetic wave shielding member 50 can be maintained in a stable manner.

As described above, the displaying apparatus according to the present general inventive concept is capable of minimizing generation of EMI by shielding-electromagnetic waves generated in the process of applying high voltage to the CRT.

Further, since the electromagnetic shielding structure is simplified, production cost may be saved.

Although the present general inventive concept has been described in connection with the exemplary embodiments illustrated in the accompanying drawings, it should be understood that the present general inventive concept is not limited thereto and those skilled in the art can make various modifications and changes without departing from the scope of the general inventive concept.

What is claimed is:

1. A displaying apparatus, comprising:

a cathode ray tube (CRT);

a printed circuit board (PCB) provided at a rear end of the CRT;

a CRT socket to electrically connect the CRT and the PCB;

a cable coupling part formed adjacent to the CRT socket;

a high voltage cable coupled to the cable coupling part; and an electromagnetic wave shielding member provided inside the cable coupling part in contact with the high voltage cable to shield the displaying apparatus from electromagnetic waves generated by the high voltage cable.

2. The displaying apparatus according to claim 1, wherein the electromagnetic wave shielding member has a cylindrical structure formed with a penetrating hole through which an end of the high voltage cable passes to a contact.

3. The displaying apparatus according to claim 2, wherein the electromagnetic wave shielding member comprises a ferrite material.

4. The displaying apparatus according to claim 1, wherein the electromagnetic wave shielding member comprises a ferrite material.

5. The displaying apparatus according to claim 1, wherein the CRT socket includes a first side disposed adjacent to the CRT and having the cable coupling part formed integrally therewith and a second side disposed adjacent to the PCB.

6. The displaying apparatus according to claim 5, wherein the first side of the CRT socket comprises:

a plurality of pin holes disposed in a circular arrangement to be coupled to a plurality of lead pins extending from the rear end of the CRT, and a cable inserting hole of the cable coupling part adjacent to the plurality of pin holes to receive an end of the high voltage cable so that a voltage carried by the high voltage cable is transmitted to at least one of the plurality of lead pins.

7. The displaying apparatus according to claim 6, wherein the second side of the CRT socket includes a plurality of socket pins to be coupled to contact points on the PCB.

8. The displaying apparatus according to claim 5, wherein the cable coupling part comprises a cable inserting hole to receive an uncovered end of the high voltage cable from the first side of the CRT socket.

9. The displaying apparatus according to claim 8, wherein the cable coupling part further comprises a penetrating hole having the electromagnetic shielding member disposed therein.

10. The displaying apparatus according to claim 9, wherein the cable coupling part further comprises a contact to hold the uncovered end of the high voltage cable in the cable coupling part and maintain contact between the uncovered end of the high voltage cable and the electromagnetic shielding member disposed in the penetrating hole.

11. The displaying apparatus according to claim 10, wherein the cable coupling part comprises a support ledge protruding from an inner wall of the cable coupling part to hold the electromagnetic shielding member in position with respect to the uncovered end of the high voltage cable and to prevent the electromagnetic shielding member from moving toward the second end of the CRT socket.

12. The displaying apparatus according to claim 1, wherein the high voltage cable is received from a fly back transformer.

13. The displaying apparatus according to claim 1, wherein the electromagnetic wave shielding member has a polygonal box shape with a penetrating hole through which an end of the high voltage cable passes to a contact.

14. A cathode ray tube (CRT) socket usable with a displaying apparatus, the CRT socket comprising:

a first set of electrical connections to be connected with a cathode ray tube;

a second set of electrical connections to be connected with a printed circuit board; and a cable coupling part adjacent to the first set of electrical connections to receive a cable carrying a high voltage and having an electromagnetic shield disposed therein to contact the cable and shield electromagnetic waves generated in the cable from exiting the cable coupling part.

15. The CRT socket according to claim 14, wherein the first and second sets of electrical connections are arranged in a circular manner.

16. The CRT socket according to claim 14, wherein the cable coupling part extends toward the cathode ray tube from a plane in which the first set of electrical connections are arranged and comprises at least one cable inserting hole to receive an uncovered end of the cable from a transformer.

17. The CRT socket according to claim 16, wherein the cable coupling part further comprises a penetrating hole extending through the cable coupling part and having the electromagnetic shield disposed therein.

18. The CRT socket according to claim 17, wherein the cable coupling part further comprises a contact to hold the uncovered end of the cable in the cable coupling part and maintain contact between the uncovered end of the cable and the electromagnetic shield disposed in the penetrating hole.

19. The CRT socket according to claim 18, wherein the cable coupling part includes a support ledge protruding from an inner wall of the cable coupling part to hold the electromagnetic shield in position with respect to the uncovered end of the cable and to prevent the electromagnetic shield from being moved toward the second set of electrical connections.

20. The CRT socket according to claim 18, wherein the contact extends from a first inner wall of the cable coupling part to hold the uncovered end of the cable against a second inner wall opposite to the first inner wall.

21. The CRT socket according to claim 14, wherein the electromagnetic shield comprises a tube shape that is inserted into the cable coupling part and the cable extends therethrough to provide the high voltage to the cathode ray tube via at least one of the first set of electrical connections.

22. A displaying apparatus, comprising:

a cathode ray tube; and an electrical connection part including:

a plurality of electrical connections to connect the cathode ray tube to a circuit board, and a cable insertion part adjacent to the plurality of electrical connections to receive a cable carrying a high voltage and to provide the high voltage to the cathode ray tube on at least one of the plurality of electrical connections, and having an electromagnetic shield disposed therein to surround the cable received in the cable insertion part and to shield the displaying apparatus from electromagnetic waves.

* * * * *